United States Patent [19]

Helbling

[11] 3,996,687

[45] Dec. 14, 1976

[54] HAND-GUN WITH ELECTRIC MOTOR DRIVE

[76] Inventor: Edward Helbling, 393 E. 5th St., Brooklyn, N.Y. 11218

[22] Filed: Dec. 23, 1974

[21] Appl. No.: 529,273

[52] U.S. Cl. ..... 42/84

[51] Int. Cl.[2] ..... F41C 19/12

[58] Field of Search ..... 42/84; 89/135

[56] References Cited

UNITED STATES PATENTS

| | | | |
|---|---|---|---|
| 2,221,706 | 11/1940 | Havill | 42/84 |
| 3,075,433 | 1/1963 | Stockholm | 42/84 |

*Primary Examiner*—Charles T. Jordan

[57] ABSTRACT

A multi-shot handgun includes a handgun body, a cylinder mounted on the handgun body for indexing, and a hammer mounted on the handgun for pivoting displacement between a retracted and a firing position. An electric motor is energized from a battery upon actuation of a switch and has an output shaft on which two pinions are mounted for shared rotation, one meshing with a gear which indexes the cylinder, and the other meshing with a gear wheel segment which is a part of the hammer. The other pinion is circumferentially incomplete and has a flat portion which permits unimpeded displacement of the gear wheel segment and thus of the hammer toward its firing position toward which it is biased by a spring. Upon closing of the switch, the electric motor simultaneously indexes the cylinder and displaces the hammer towards its retracted position so that, when the hammer is released for displacement toward the firing position, it impacts that cartridge which is indexed into the position of alignment with the path of displacement of the hammer so that the propellant charge of the cartridge is ignited.

3 Claims, 3 Drawing Figures

FIG. 1
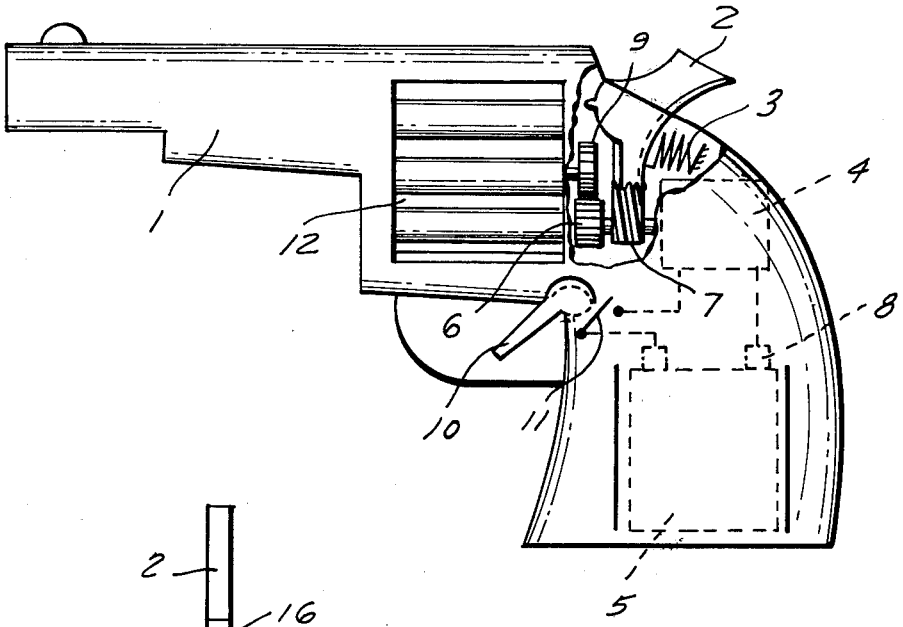
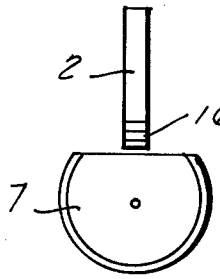
FIG. 2
FIG. 3
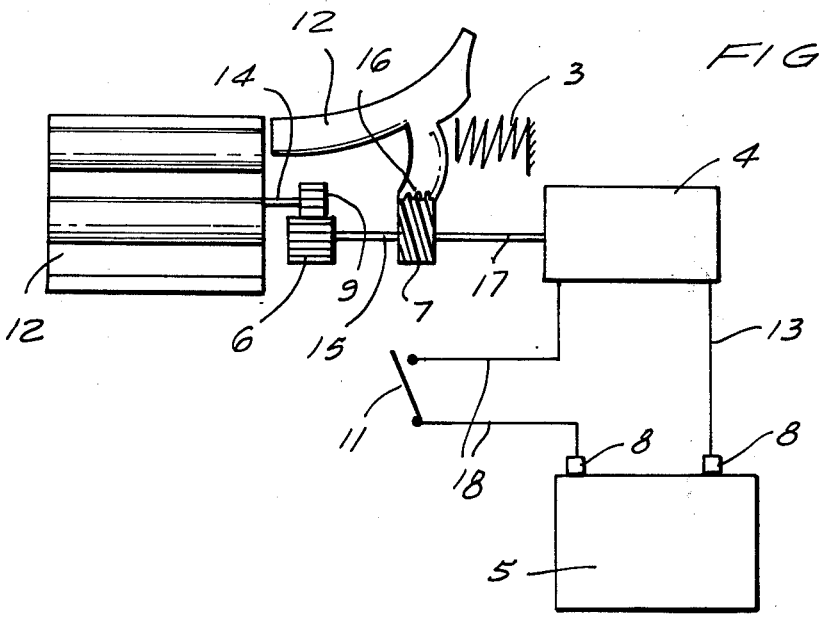

HAND-GUN WITH ELECTRIC MOTOR DRIVE

BACKGROUND OF THE INVENTION

The present invention relates generally to a motor driven automatic weapon such as a revolver fire arm, that requires less hand pressure on the trigger. This is accomplished by use of an electric motor drive, thereby providing better accuracy and quicker response. Further, repeated accuracy is obtained by the general smoothness of operation of the electric motor, as compared to the conventional single or double action handguns, or to other automatic handguns or machine guns that are spring or gas propelled to return to second round etc. The electric trigger will eliminate the pulling needed in the conventional handgun.

SUMMARY OF THE INVENTION

It is a general object of the invention to provide a more useful and accurate hand or machine gun, with all its required safety features.

DESCRIPTION OF DRAWING

Insofar as the general construction of handguns is already well known, and insofar as the present invention is concerned with a drive for a handgun, including a battery cell and an electric motor to operate the firing and rotating of a cylinder which accommodates cartridges, and also to operate a firing pin which ignites the propellent charge of the succession of cartridges in said cylinder by means of gears and/or fluid motors, the drawings illustrate only those details of the handgun proper which are needed for understanding the present invention which resides in the motor, battery and gear system.

FIG. 1 shows the present invention as embodied in a handgun, in a diagrammatic manner;

FIG. 2 shows a front view of a detail of the arrangement; and

FIG. 3 shows internal parts of the driving mechanism of the present invention.

DESCRIPTION OF THE PREFERRED EMBODIMENT

In FIG. 3 microswitch 11, when closed, energizes motor 4 through wires 18, and 13 and electric power is delivered from battery 5, to motor 4. FIG. 3 also shows battery terminals 8 to which the wires 13 and 18 are connected. Once motor 4 is energized, shaft 17 then turns driving gear 7 thereby moving gear 16 of hammer 2 to firing position, and depressing spring 3; also, while gear 7 is turned, shaft 15 turns gear 6 and gear 6 turns gear 9 and gear 9 turns shaft 14 to turn cylinder 12, putting into position the first shot of the weapon, and this cycle goes on for every shot thereafter. One full rotation of shaft 17 completes one shot fired from cylinder 12.

FIG. 2 shows a front view of gear 7, where gear 7 makes one rotation in mesh with the gear 16 of hammer 2, so that, when full rotation is accomplished, gear 16 is free to return to fire position due to the action of spring 3 being released as a result of juxtaposition with a flat portion of gear 7.

FIG. 1 shows trigger 10 to energize microswitch 11 of FIG. 1.

SPECIFIC DESCRIPTION

Insofar as the specific description is concerned, it is to be mentioned that the prime source of power is from a dry cell battery that supplies electric power to the electric motor and this electric motor, in turn, turns the described firing mechanism through gears and shafts; thus, the handgun is fired with less deflection caused by pulling the trigger than in the conventional firearms, thus reducing the likelihood of missing the target and achieving better accuracy and quicker response to the firing signal caused by pulling the trigger.

I claim:

1. In a handgun, a combination comprising a handgun body; a cylinder mounted on said handgun body for indexing about an axis and having a plurality of openings distributed about said axis equidistantly therefrom and each adapted to accommodate a cartridge; a hammer mounted on said handgun body for displacement in a path between a retracted and a firing position and operative for impacting, during the displacement from said retracted to said firing position, a cartridge which is accommodated in a respective opening of said cylinder which is aligned with said path to thereby ignite the propellant charge of the cartridge; means for simultaneously indexing said cylinder and displacing said hammer toward said retracted position of the latter, including a source of electric power, an electric motor having an output shaft, an electric circuit supplying electric power from said source to said electric motor, an electric switch interposed in said electric circuit and operative for establishing and interrupting supply of electric power to said electric motor, a first gear transmission between said output shaft of said electric motor and said cylinder, and a second gear transmission interposed between said output shaft of said electric motor and said hammer; and means for displacing said hammer toward said firing position thereof, including at least one spring which is connected to and extends between said hammer and said handgun body, respectively, and which biases said hammer toward said firing position thereof.

2. A combination as defined in claim 1; and further comprising a pivot mounting said hammer on said handgun body for pivoting displacement between said positions thereof about a pivot axis which is substantially normal to and offset from the output shaft of said electric motor.

3. A combination as defined in claim 2, wherein said second gear transmission includes a worm pinion mounted on said output shaft of said electric motor for shared rotation therewith, and a worm wheel segment on said hammer sharing the pivoting displacement thereof about said pivot axis and engaging said worm pinion during said pivoting displacement toward said retracted position; and wherein said worm pinion is circumferentially incomplete having an axially extending flat portion which releases said gear wheel segment of said hammer when aligned therewith, whereby said hammer is pivotally displaced by said spring toward said firing position.

* * * * *